United States Patent [19]

Syfert

[11] Patent Number: 4,912,688

[45] Date of Patent: Mar. 27, 1990

[54] AUTOMATIC DISPLAY ILLUMINATION FOR A MULTIMODE WRISTWATCH

[75] Inventor: Timothy T. Syfert, Burlington, Conn.

[73] Assignee: Timex Corporation, Waterbury, Conn.

[21] Appl. No.: 392,697

[22] Filed: Aug. 11, 1989

[51] Int. Cl.[4] ..... G04B 19/30

[52] U.S. Cl. ..... 368/67; 368/227

[58] Field of Search ..... 368/227, 67, 184–199

[56] References Cited

U.S. PATENT DOCUMENTS

| | | | |
|---|---|---|---|
| 4,033,108 | 7/1977 | Bennett et al. | 58/50 |
| 4,084,401 | 4/1978 | Belardi | 58/50 |
| 4,094,139 | 6/1978 | Nomura et al. | 58/50 |
| 4,207,734 | 6/1970 | Moyer | 368/227 |
| 4,283,784 | 8/1981 | Horan | 368/87 |
| 4,780,864 | 10/1988 | Houlhan | 368/10 |
| 4,783,773 | 11/1988 | Houlihan et al. | 368/108 |

*Primary Examiner*—Bernard Roskoski

*Attorney, Agent, or Firm*—William C. Crutcher

[57] ABSTRACT

An improvement in a multimode electronic wristwatch of the type having a display, a lamp for illuminating the display, manually actuated switches and an integrated circuit programmed in a first logic sequence to light the lamp in response to actuation of a first switch, to change modes in response to actuation of a second switch and to change information displayed in each mode in response to actuation of a third switch. The improvement comprises transfer logic responsive to actuating the first switch for more than 2 seconds so as to alter the first logic sequence into a second logic sequence, wherein actuation of either of the second or third switches will automatically light the lamp momentarily in addition to duplicating the first logic sequence. The program returns the watch to the first logic sequence after a period of time, 3 hours in the example shown.

4 Claims, 1 Drawing Sheet

AUTOMATIC DISPLAY ILLUMINATION FOR A MULTIMODE WRISTWATCH

BACKGROUND OF THE INVENTION

This invention relates generally to improvements in operating an illuminated electroptic display for a multimode or multifunction wristwatch. More particularly, it relates to an improved logic sequence for a wristwatch with multiple manual switch actuators and provisions for illuminating the dial or display of the wristwatch.

Means for illuminating wristwatch dials or liquid crystals displays which could otherwise not be seen in the dark are well known. The illuminating lamps may be incandescent lamps arranged to serve as a backlight for a liquid crystal display as shown in U.S. Pat. No. 4,342,105—Dorfman. Other types of backlighting lamps, such as electroluminescent lamps, have also been used in watches, as shown in U.S. Pat. No. 4,500,173—Leibowitz et al.

Generally, the lamp illuminating the display or dial is lit by pressing a pushbutton to close contacts inside the watchcase so as to change the electrical potential on an integrated circuit input pin, signifying a switch closure.

In actual practice, the manual actuator may either be a dedicated switch which only serves to light the illuminating lamp, or the switch may incidentally cause the lamp to light while some other function is being performed with the switch. Electronic watches are also known, in which various special lighting functions or timing functions are performed when the manual actuators are operated in a preselected manner. U.S. Pat. No. 4,084,401—Belardi et al describes a digital LED display watch, in which an additional recessed button is provided to manually select the duty cycle of the display and thus alter apparent brightness and power consumed. U.S. Pat. No. 4,094,139—Nomura et a describes a display control circuit for an electronic timepiece for controlling a timer circuit to vary the length of time for the display of time or calendar information. U.S. Pat. No. 4,033,108—Bennett et al describes an LED electronic watch, in which the display is quiescent to conserve power, by providing an automatic cut-off system to discontinue the display immediately after the time is displayed.

Multimode, multifunction wristwatches (or wrist instruments) are known which include a display, a lamp for illuminating the display, a number of manually actuated switches and an integrated circuit programmed in a preselected sequence. Examples of such watches are seen in U.S. Pat. No. 4,783,773—Houlihan et al, U.S. Pat. No. 4,780,864—Houlihan and U.S. Pat. No. 4,283,784—Horan, all of the foregoing being assigned to the present assignee. In the foregoing patents, which are merely exemplary of multimode electronic wrist instruments or multifunction wristwatches, one of the manual actuators may typically serve to repetitively cycle the instrument through a number of modes or operating states in each of which a different type of information is displayed. Such modes may include, in a multifunction watch, the time of day, chronograph, dual time zone, elapsed time and so forth. By special preselected actuation of one of the switches, the wristwatch may b further converted into a computer, a speedometer, pulsometer or any other type of device, subject only to the imagination of the designer and programmer of the integrated circuit. While in any of these modes, another manual switch actuator may be employed to change the information being displayed in that mode or state, such as initiating the chronograph timing or setting the time-of-day, or performing a calculation.

A common problem occurring with the multimode electronic wristwatch or wrist instrument described above is that a change of mode or a change of information displayed within a mode may not be observed in the night or under poor light conditions without also pressing the manual actuator for illuminating the display. If a series of such activities are to be performed in conditions of little or no ambient light then this calls for repetitive actuation of the illuminating pushbutton. On the other hand, considerations of power and battery conservation would not allow the illuminating lamp to remain lighted at all times.

Accordingly, one object of the present invention is to provide an improved method of controlling the illumination of the display in a multimode electronic wristwatch.

Still another object of the invention is to provide an improved means for operating an electronic wristwatch to provide automatic illumination of the display while also conserving power.

SUMMARY OF THE INVENTION

Briefly stated, the invention comprises an improvement in a multimode electronic wristwatch of the type having a display, a lamp for illuminating the display, a plurality of manually actuated switches and an integrated circuit programmed in a first logic sequence to light the lamp in response to actuation of a first switch, to change modes in response to actuation of a second switch and to change information displayed in each mode in response to actuation of a third switch. The improvement comprises transfer logic means responsive to a preselected type of actuation of one of the switches which is adapted to alter the first logic sequence into a second logic sequence, wherein actuation of either of the second or third switches will automatically light the lamp for a first predetermined time in addition to duplicating the first logic sequence. In a preferred embodiment, the logic means includes means to return the watch to the first logic sequence after a longer second predetermined time.

DRAWING

The subject matter which is regarded as the invention is particularly pointed out and distinctly claimed in the concluding portion of the specification. The invention, however, both as to organization and method of practice, together with further objects and advantages thereof, may best be understood by reference to the following description, taken in connection with the accompanying drawing, in which:

DESCRIPTION OF THE PREFERRED EMBODIMENT

Figure 1:
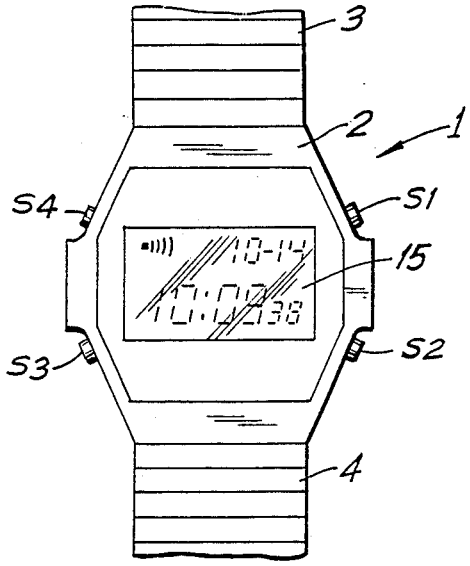
FIG. 1 is a plan view of a multimode electronic wristwatch in simplified form.

Referring now to FIG. 1 of the drawing, a multimode electronic wristwatch 1 includes a case 2 adapted to be held on the wrist by a strap, portions of which are seen at 3 and 4. The wristwatch case includes 4 manual pushbutton actuators S1, S2, S3, S4 arranged to close spring contacts (not shown) inside the watch case 2. An electroptic display 15, which is commonly a liquid crystal display (or LCD) displays digits, letters or other symbols when activated by a microcomputer inside the watch in the form of an integrated circuit.

Figure 2:
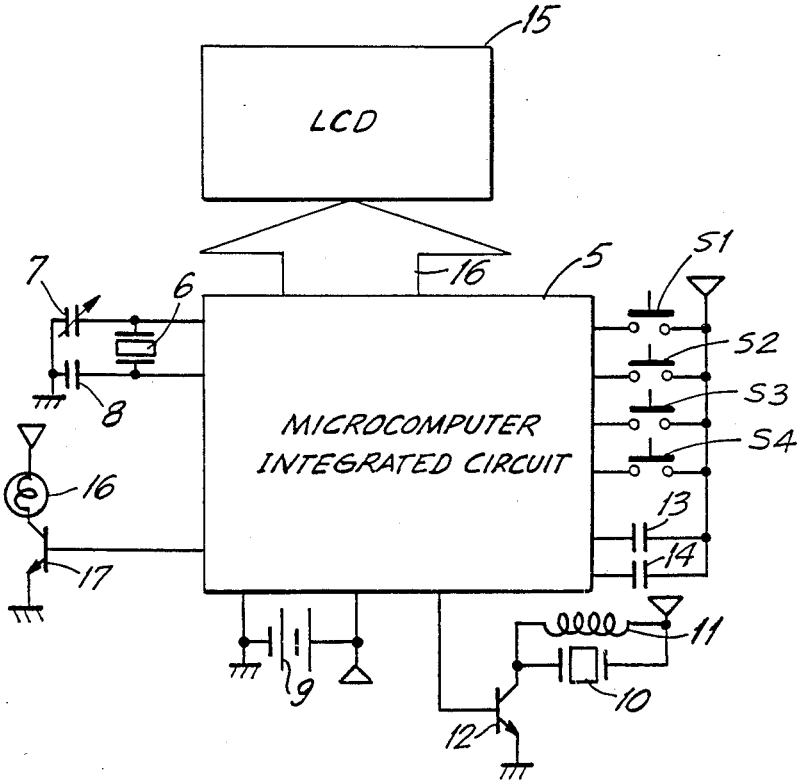
FIG. 2 is a block diagram of a circuit for the wristwatch of FIG. 1, together with external components such as lamp, switches and display.

Referring to FIG. 2 of the drawing, a schematic block diagram of the electrical connections is shown which is in accordance with conventional multimode electronic watch technology well known to those skilled in the art. A programmable microcomputer 5, in the form of a mask-programmable integrated circuit is bonded to a printed circuit board (not shown) and includes suitable pin connections and leads connected to various external components shown in the diagram which are also mounted on the printed circuit board. A quartz crystal 6 connected in circuit with capacitor 7 and 8 and connected to the oscillator pins of the integrated circuit provide a high-frequency time base.

A battery power source 9 is provided in the form of a button type energy cell in the watch case. A watch alarm is made up of a piezoelectric crystal 10, inductance coil 11 and drive transistor 12. Two fixed external capacitors 13, 14 combined with other circuit elements combined inside the integrated circuit 5 serve to boost the output voltage to drive LCD 15 through a display bus 16, which represents the several parallel leads connected to the various actuatable segments of the LCD display 15 (also shown in FIG. 1).

Display 15 is arranged in close proximity with, so as to be illuminated by, a lamp 16 when the lamp is lit by a switching signal from integrated circuit 5 applied to the base of switching transistor 17. Lamp 16 is represented as an incandescent lamp which may either be a backlight behind LDC 15 or arranged to illuminate it from the top or from the side. It is also within the scope of the invention to use other types of illuminating lamps such as electroluminescent lamps to provide direct lighting or backlighting of the display 15.

Figure 3:
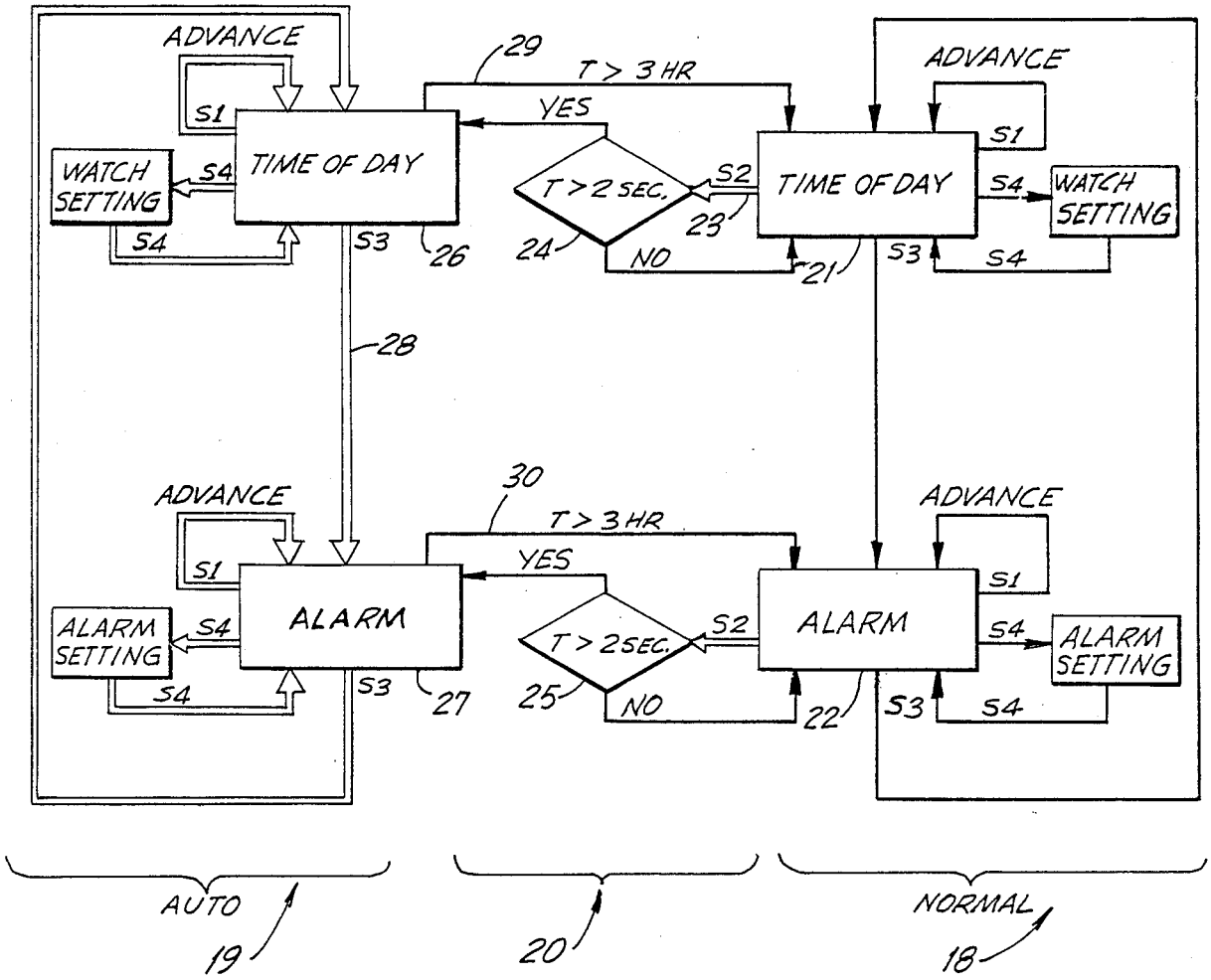
FIG. 3 is a block diagram of a two mode wristwatch illustrated sequence of operations in response to manually actuated switches in accordance with the invention.

Referring now to FIG. 3 of the drawing a "state" diagram is shown in schematic form. Each of the large rectangles describes the type of display shown on the electroptical display 15 when the instrument is in that state. The small rectangles represent a state in which change of displayed information may be controlled by the operator. The instrument continues to operate under control of the particular subroutine of the program in the microcomputer chip until the instrument is placed into another state. Manipulation of the electronic wristwatch to illuminate the display and carry out the various functions and capabilities is by selective actuation of the manually actuated switches S1–S4. The well known programming technique for determining whether the switches are opened or closed and taking appropriate action is through a computer program stored in the microcomputer memory, in which each switch condition is tested during each complete interrogation cycle in a loop. If any switch is closed, the program branches to a subroutine which initiates a counter. The counter determines how long the switch has been closed or, if the watch has entered another "state" how long it has been in that "state".

Referring to FIG. 3 of the drawing, a very simple multimode electronic wristwatch is illustrated which has only two main states, one displaying the time-of-day, and the other for displaying the setting of the alarm. A normal or first logic sequence is illustrated on the right hand side generally by reference numeral 18, an automatic display illumination or second sequence on the left hand side by reference numeral 19, and transfer logic 20 in the center. Referring to the first logic sequence 18, a first state in which the LCD displays time-of-day is illustrated by rectangle 21, and a second state in which the display shows the alar setting is represented by rectangle 22. As shown by the flow arrows, depression of manually actuated switch S3 will change the watch from one state to the next in a periodically repeating cycle. When the watch is showing time of day, depression of switch S4 will cause the watch to enter a substate to condition the watch for operator setting, whereupon depression of switch S1 will advance the setting to a new desired time setting. When the watch is in state 22 showing the alarm, depression of switch S4 will cause the watch to enter a substate which will allow the operator to reset the alarm, whereupon depression of switch S1 will advance the digits to the new setting, whereafter depression of switch S4 will end the alarm setting capability.

At any time, during the normal logic sequence, depression of switch S2 will cause the microcomputer to close the transistor switch 17 (FIG. 2) to light the lamp so as to illuminate LCD 15. The lamp is lighted for a period of two seconds as determined by a counter subroutine, after which the transistor switch 17 is reopened and the light is extinguished. Lighting of the lamp is symbolized in the flow chart of FIG. 3 by a double flow arrow such as 23. Therefore, when the watch is showing the time-of-day in state 21, actuation of pushbutton S2 lights the lamp momentarily. This is all in accordance with the prior art and presents the following problem. Should one desire to set the alarm at night, it is necessary to depress S3 to change to the alarm state, then ascertain the alarm setting by pressing the light actuator S2, and then changing the alarm setting with switches S4 and S1 while periodically ascertaining the condition of the alarm by depressing light switch S2. This is an awkward procedure, which is alleviated by the present invention.

In accordance with the improvement of the present invention, depression of switch S2 for longer than two seconds, as illustrated by the decision symbols 24 or 25, causes the alteration of the program into a second logic sequence 19.

The second logic sequence is identical to the first logic sequence in that there is a time of day display state 26, and an alarm setting display state 27, and wherein actuation of switches S1, S4 perform the same watch setting and alarm functions as they did in the previously described first logic sequence 18. However, in the automatic or altered logic sequence, additional program instructions are included upon the detection of each switch closure to actuate the lamp which illuminates the display. Such alteration may be accomplished either by branching to stored program, or by setting a flag which is tested at each switch closure interrogation in a single stored Program, causing illumination of the light to take place. The two are equivalent and are depicted in FIG. 3 as though there were two separate programs. Momentary lighting of the display lamp is symbolized by the double line flow arrows in the diagram. As an example, actuation of switch S3 when the watch is in time of day state not only changes the state to alarm display state 27, but also causes the display lamp to light for a period of two seconds. This is illustrated by flow line 28. Similarly, when the watch is in alarm state 27 and pushbutton S4 is actuated, button 54 not only conditions the watch to change th alarm setting, but also causes the lamp to light.

In order to conserve power, the automatic illumating mode is terminated after a second period of time. Return of the operating sequence of the watch from the second logic sequence 19 to the first logic sequence 18 is preferably accomplished by a timing counter incorporated into the program. Timing commences when the second logic sequence 19 is entered by depressing pushbutton S2 for more than two seconds. The return to the first logic sequence is illustrated by flow arrows 29 and 30. The selected time period is relatively long, here 3 hours. If desired, the watch also may be programmed to return to the normal logic sequence upon reactuating switch S2 in a preselected manner. The change from the first sequence to the second sequence could also easily be initiated by operating some other switch than 52 in a preselected manner.

A very simple two state wristwatch has been described in order to illustrate the principle of the invention. However, the invention is applicable to any number of modes and states, as well as applicable to multiple mode wrist instruments performing functions other than timekeeping as illustrated by the aforementioned U.S. Pat. Nos. 4,780,864 or 4,783,773. The term "state" and "mode" are used interchangeably herein and not intended by way of limitation.

Where there has been described what is considered to be the preferred embodiment of the invention, other modifications will become known to those skilled in the art, and it is desired to cover in the appended claims all such modifications as fall within the true spirit and scope of the invention.

I claim:

1. In a multistate electronic wrist instrument having a display, a lamp for illuminating said display, a plurality of manually actuated switches, and an integrated circuit programmed to provide a plurality of states, said integrated circuit also being programmed in a first logic sequence to light said lamp in response to actuation of a first switch, to change states in response to actuation of a second switch and to change information displayed in a state in response to actuation of a third switch, the improvement comprising:

transfer logic means responsive to a preselected manner of actuation of one of said switches adapted to alter said first logic sequence into a second logic sequence substantially similar to said first sequence, but for actuation of said lamp, wherein actuation of either of said second or third switches will automatically light said lamp for a predetermined time in addition to duplicating the action of said second or third switches in said first logic sequence.

2. The improvement according to claim 1, wherein said transfer logic means is responsive to actuation of said first switch for a first predetermined period of time.

3. The improvement according to claim 1, wherein said transfer logic means is adapted to return the second logic sequence to the first logic sequence after a second longer predetermined period of time.

4. The improvement according to claim 1, wherein said transfer logic means is responsive to actuation of said first switch for a first preselected period of time ad adapted to return said second logic sequence to said first logic sequence after a second longer preselected period of time.

* * * * *